US006267323B1

(12) United States Patent
Phelps et al.

(10) Patent No.: US 6,267,323 B1
(45) Date of Patent: Jul. 31, 2001

(54) DISPENSER APPARATUS AND METHOD

(75) Inventors: Stephen L. Phelps, Lilburn; Christopher O. Luettgen, Roswell, both of GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/538,544

(22) Filed: Mar. 30, 2000

(51) Int. Cl.[7] ..... B65H 16/02

(52) U.S. Cl. ..... 242/595.1; 242/588.3; 312/34.8

(58) Field of Search ..... 242/588.3, 594.1, 242/594.2; 312/34.8, 34.21, 34.23

(56) References Cited

U.S. PATENT DOCUMENTS

| | | | | |
|---|---|---|---|---|
| Re. 21,678 | * | 12/1940 | Daykin | 312/34.8 |
| 828,115 | * | 8/1906 | Hoell | 242/594.1 |
| 849,066 | * | 4/1907 | Hahn | 242/594.2 |
| 1,122,673 | * | 12/1914 | Winter et al. | 312/34.8 |
| 1,239,960 | * | 9/1917 | Pohlman | 242/594.2 |
| 1,487,607 | * | 3/1924 | Rosen | 242/588.3 |
| 1,632,265 | * | 6/1927 | Axberg | 242/594.2 |
| 1,767,860 | * | 6/1930 | Shaffer | 242/588.3 |
| 2,107,603 | * | 2/1938 | Ellenburg | 242/588.3 |
| 2,228,842 | * | 1/1941 | Nyberg | 242/594.2 |
| 2,288,332 | * | 6/1942 | Steiner et al. | 312/34.8 |
| 2,806,529 | * | 9/1957 | Bulman | 312/34.8 |
| 2,924,494 | * | 2/1960 | Sloier | 242/594.1 |
| 3,418,029 | * | 12/1968 | Wooster | 312/34.8 |
| 3,494,518 | * | 2/1970 | Goss | 312/34.8 |
| 4,614,312 | | 9/1986 | Del Pino . | |
| 5,058,792 | | 10/1991 | Morand . | |
| 5,149,003 | | 9/1992 | Tharp . | |
| 5,170,958 | | 12/1992 | Brown . | |
| 5,172,840 | | 12/1992 | Bloch et al. . | |
| 5,253,818 | | 10/1993 | Craddock . | |
| 5,454,500 | | 10/1995 | Chen . | |
| 5,509,593 | | 4/1996 | Bloch et al. . | |
| 5,601,253 | | 2/1997 | Formon et al. . | |
| 5,634,610 | * | 6/1997 | Walsh | 242/588.3 |
| 5,645,244 | | 7/1997 | Moody . | |
| 5,687,928 | * | 11/1997 | Lassiter | 242/594.1 |
| 5,829,710 | | 11/1998 | Halle et al. . | |
| 5,833,169 | | 11/1998 | Morand . | |
| 5,868,335 | | 2/1999 | Lebrun . | |
| 5,954,256 | | 9/1999 | Niada . | |
| 6,105,898 | * | 8/2000 | Byrd et al. | 312/34.8 |

* cited by examiner

*Primary Examiner*—Emmanuel M. Marcelo
(74) *Attorney, Agent, or Firm*—Dority & Manning, PA

(57) ABSTRACT

An apparatus and method for dispensing cored or coreless rolled paper is disclosed. The apparatus comprises a housing having a dispensing side from which rolled paper products may be dispensed. A doorway enclosed by one or more doors allows the insertion of a rolled paper product through the doorway to the interior of the housing in a simple and efficient manner. One or more roller guides may be mounted on a door to contact the outer circumferential surface of the rolled paper to support the rolled paper within the housing, and to assist in dispensing the rolled paper from the housing. Cored or coreless rolled paper may be dispensed from the dispenser.

19 Claims, 10 Drawing Sheets

DISPENSER APPARATUS AND METHOD

FIELD OF THE INVRNTION

The invention relates to rolled product dispenser apparatus and methods. In particular, the invention is directed to apparatus for dispensing paper from jumbo or large paper rolls. The dispensers disclosed in the invention are convenient to re-load with new paper rolls, and may be used with either cored or coreless rolled paper.

BACKGROUD OF THE INVENTION

Absorbent paper products for use in commercial buildings typically are dispensed from wall-mounted dispensers. Rolled paper products include toilet tissue, paper toweling, and the like. These products may be stored and dispensed using hollow cylindrical cores that form the support structure about which the paper is wrapped. These rolled, cored paper products are loaded into wall mounted dispensers for use by the public. Most rolled cored products are dispensed by mounting the core on a spindle passing through the core of the roll. In some cases, a mounting structure operatively engages each end of the core, on the sides of the rolled product, thereby suspending the rolled product to facilitate dispensing.

In other prior art dispensers, a coreless roll may be used. Some coreless rolls provide paper wound into the center of the roll. The paper may be indented at the geometric center of the roll on each side, forming an indentation axis about which the roll may be suspended, and paper dispensed from the roll.

Large or jumbo sized toilet tissue rolls are dispensed in restrooms of commercial buildings and in other locations in which a relatively high volume of rolled paper products are deployed. Typically, the large rolls are mounted in dispensers so that the core of the roll is supported on an axis of rotation, or hub, within the dispenser housing. These large size rolls may be largely invisible to the consumer, as often they are protected in a closed housing which dispenses the paper to the user at its lower edge.

Conventional large roll dispensers may feature a housing cover that can be removed only with a key to facilitate reloading the dispenser. Other dispensers employ a hinged housing cover which must be opened or moved laterally to facilitate reloading the dispenser. Reloading dispensers is a time consuming task for maintenance personnel. In general, it is desirable to provide a process for reloading dispensers in a manner that is efficient and simple. One challenge in commercial dispenser design is to provide a dispenser that may be reloaded easily and quickly, but still offers security to the rolled paper product, thereby protecting the dispenser contents from vandalism and theft.

Coreless rolls of paper product are employed in applications where it is desirable to avoid using a core in the center of the rolled product. Coreless rolled products may be manufactured as provided in U.S. Pat. No. 5,620,148 to form a depression in the side of the roll that facilitates supporting and dispensing the roll. Devices capable of dispensing coreless rolled paper products have been disclosed as provided in U.S. Pat. No. 5,697,576. Another patent, U.S. Pat. No. 5,875,985, is directed to a method of treating a coreless roll to create a mounting hole in at least one end of the roll to provide a self-supporting roll for mounting in a rotary dispenser.

It would be desirable to provide a dispenser capable of dispensing either cored or coreless paper rolls easily and efficiently. Further, it would be desirable to provide a dispenser that may be loaded quickly and easily, without key-operated external housing covers that must be removed or unlocked to reload the dispenser.

SUMMARY OF THE INVENTION

An apparatus and method for dispensing cored or coreless rolled paper is disclosed. The apparatus comprises a housing having a dispensing side from which rolled paper products may be dispensed. A doorway enclosed by one or more doors allows the insertion of a rolled paper product through the doorway to the interior of the housing in a simple and efficient manner. One or more roller guides may be mounted at the base or bottom of the dispenser to contact the outer circumferential surface of the rolled paper, thereby supporting the rolled paper within the housing. The roller guides also assist in dispensing the rolled paper from the housing. Cored or coreless rolled paper may be dispensed from the apparatus.

In the invention, a dispenser for rolled paper is disclosed comprising a housing, the housing having an exterior surface on the outside of the housing and an interior space on the inside of the housing. The housing has a dispensing side from which rolled paper products may be dispensed, and a doorway. The doorway provides an entry point capable of accommodating the insertion of a rolled paper product through the doorway from the outside of the housing to the interior of the housing.

Reloading the apparatus with a new roll is simple and convenient. Cored or coreless paper may be dispensed using the invention of this application. The ability to dispense cored or coreless paper is evident because the dispenser does not support the rolled paper by way of a spindle or other centralizer-type device, but instead allows the paper to dispense by resting the rolled paper upon guide rollers which turn, allowing the paper to feed to the outside of the housing. Even coreless paper without any means of suspending the paper by external support of the roll axis may be dispensed using the invention of this application.

In one embodiment, a support frame is connected to the housing and is capable of supporting a rolled paper product in a position to dispense paper to the outside of the housing. Further, a roller guide is presented, the roller guide being mounted on the support frame. The rolled paper contacts the roller guide, and the roller guide provides a rotatable contact surface for dispensing rolled paper. In one embodiment of the invention, the door is attached to the housing by a hinge. In some aspects of the invention, the door operates as a support frame on the dispensing side of the dispenser. There may be more than one door, and in a desirable embodiment there are two doors, in which each door contains one roller guide to support the roll and assist in dispensing paper.

One advantage of the invention is the opportunity and ability it affords maintenance personnel to load new rolls into the dispenser with only one hand, in one easy and swift motion. It is not required that the maintenance personnel use keys or otherwise manually unlock or re-adjust the housing in order to load a new roll into the dispenser.

In some embodiments of the dispenser, the doors may be located on the side of the dispenser, rather than on the bottom, such as, for example, in restroom stalls in which a handicapped rail is located immediately beneath the mounted dispenser. When there is an obstruction on the underside of the dispenser, it is possible to provide an embodiment in which side doors facilitate loading a new roll, while the dispenser still may dispense paper from below. In some applications, there is enough room below the mounted dispenser to dispense paper, but not enough space to facilitate loading a new roll from underneath the dispenser. In the application of this invention, the dispenser the paper may be dispensed in either a clockwise or counter-clockwise rotation, and in most cases there is no correct or incorrect orientation for the paper to be inserted into the dispenser, as the paper will feed in either direction.

One advantage of the invention is that in one embodiment, it is possible to touch the rolled paper using an extended hand through the doorway of the housing, such as when loading a new roll, or when feeding the roll to reveal a "tail" of paper for dispensing.

In one embodiment of the apparatus the doors are hinged. In many cases, the outer circumferential surface of the rolled paper will bias against at least two guide rollers while dispensing paper to the outside of the housing. Centering ribs may (optionally) be located on the inside surface of the housing to assist in centering the roll over the guide rollers.

A method of dispensing a paper roll from a dispenser with reduced friction is disclosed. The method includes providing a doorway on a dispenser, wherein the doorway provides the paper roll entry point for re-loading the dispenser with a paper roll. Also, the doorway provides an exit point for paper released from the dispenser, wherein the doorway is bounded by at least one door capable of opening to the outside of the dispenser. In the method, the door is opened, and the paper roll is inserted through the doorway into the dispenser. The paper roll rests upon a pair of guide rollers. The paper is provided through the doorway to the outside of the dispenser.

BRIEF DESCRIPTION OF THE DRAWINGS

A full and enabling disclosure of this invention, including the best mode shown to one of ordinary skill in the art, is set forth in this specification. The following Figures illustrate the invention.

DETAILED DESCRIPTION OF THE INVENTION

Reference now will be made to the embodiments of the invention, one or more examples of which are set forth below. Each example is provided by way of explanation of the invention, not as a limitation of the invention. In fact, it will be apparent to those skilled in the art that various modifications and variations can be made in this invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features and aspects of the present invention are disclosed in or are obvious from the following detailed description. It is to be understood by one of ordinary skill in the art that the present discussion is a description of exemplary embodiments only, and is not intended as limiting the broader aspects of the present invention, which broader aspects are embodied in the exemplary constructions.

Figure 1:
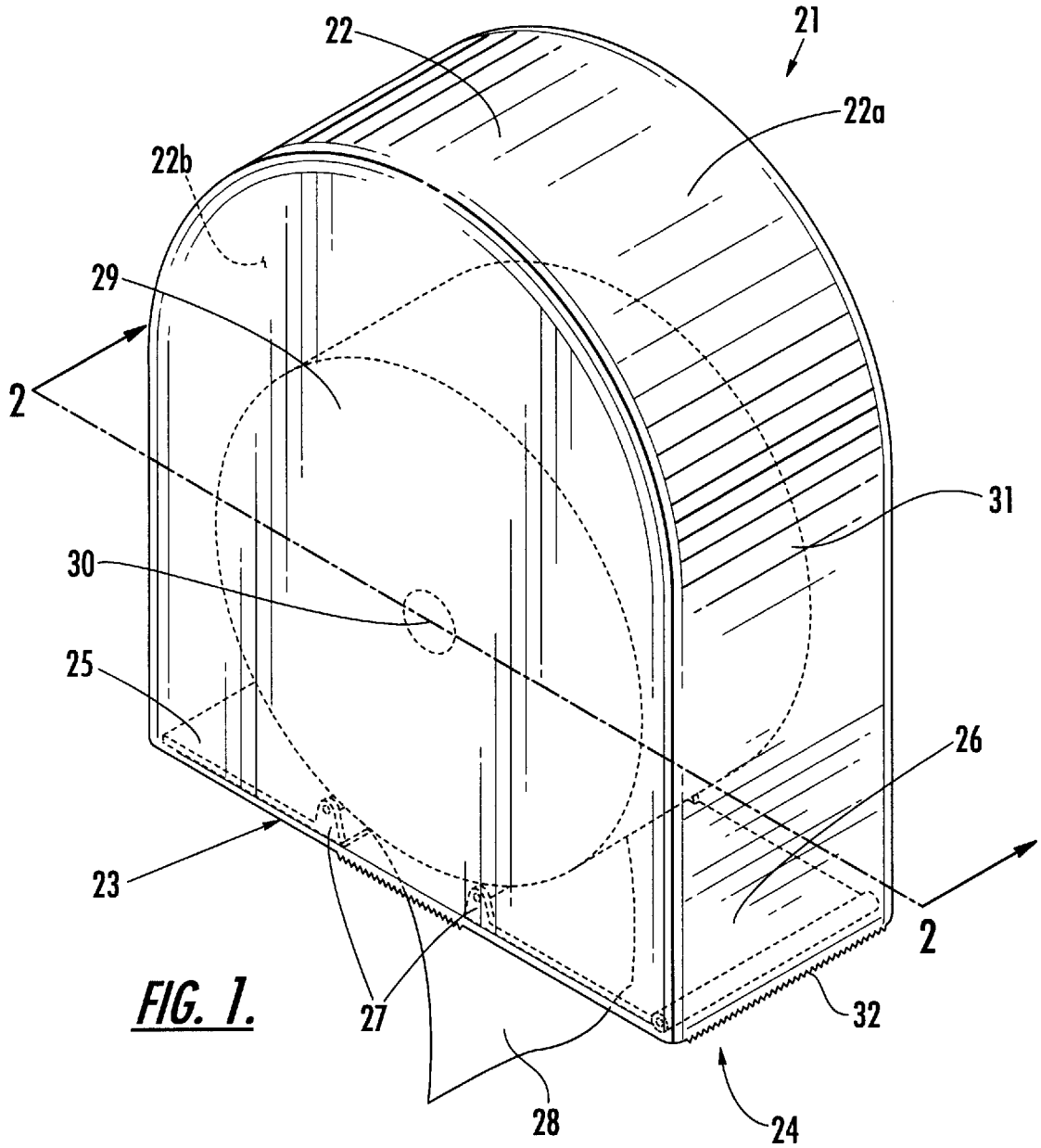
FIG. 1 is a perspective view of a dispenser of this invention.

Turning to FIG. 1, a dispenser 21 is shown in which exterior surface of housing 22 defines an interior space capable of holding a paper roll 29. Exterior surface 22*a* and interior space 22*b* are shown. A dispensing side 23 of the housing (i.e. underneath the dispenser embodiment shown in FIG. 1) is shown. In this particular embodiment, the doorway 24 (bottom or underneath side) of the housing is also the dispensing side of the housing, but other embodiments of the invention show a configuration in which the doorway is on a different side which is not the dispensing side of the housing. First door 25 and second door 26 independently hinge to facilitate loading of the paper roll 29 into the housing, as will be seen below. In the rest position, as shown in FIG. 1, the doors form part of a support frame 27 which supports the roll in position for dispensing. Rolled paper tail 28 is available for a user to grasp below the dispenser. Core 30 forms the center of the paper roll 29. The side 31 of the housing contains a serrated tear strip 32 on its lower edge.

Figure 2:
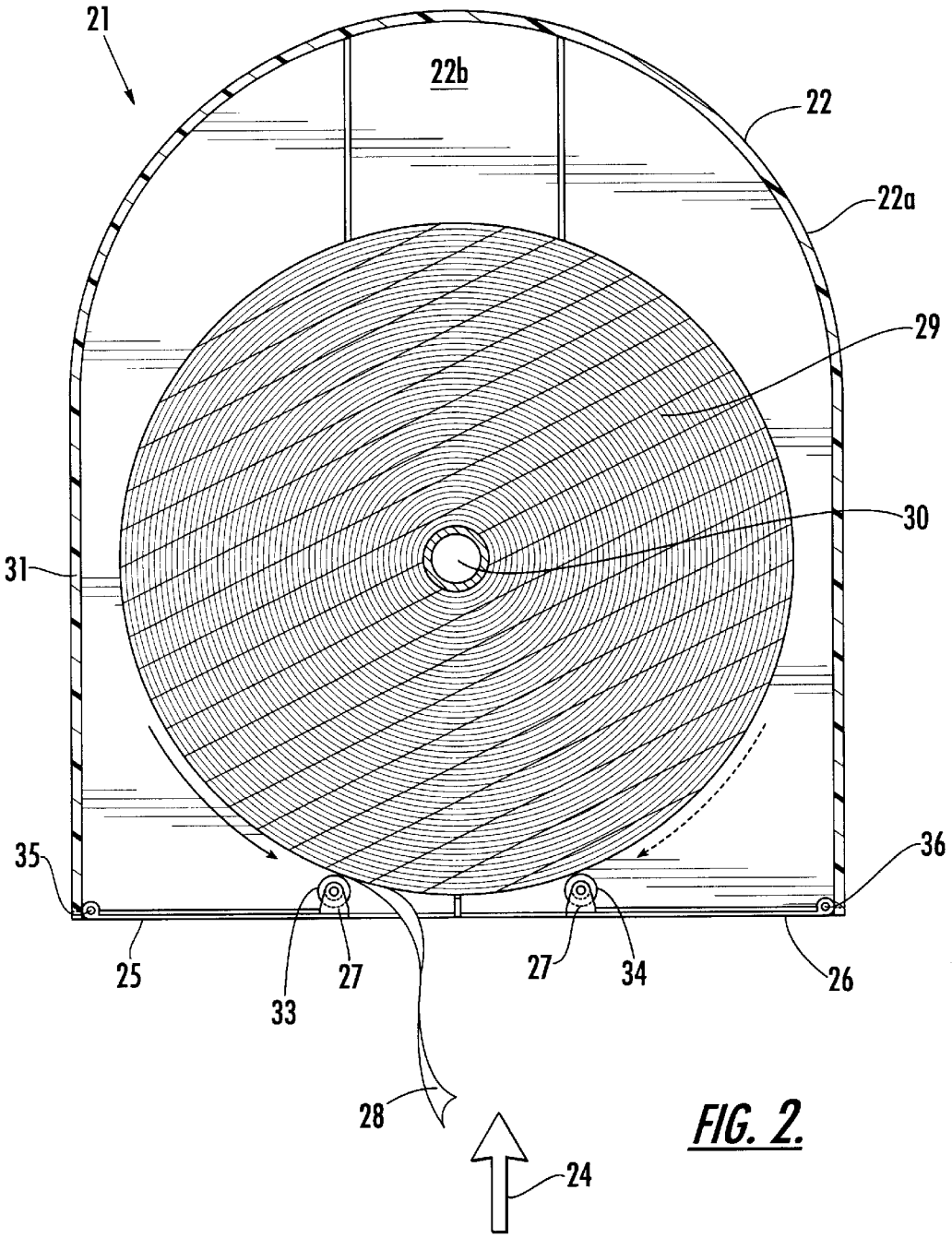
FIG. 2 shows a side sectional view of a dispenser as along lines 2—2 from FIG. 1.

In FIG. 2, roller guide 33 and roller guide 34 each support from beneath the paper roll 29 within the housing. The paper roll is shown in the dispensing position. Hinges 35 and 36 support doors 25 and 26 respectively. Centering ribs 37 and 38 provide lateral support to support the paper in the dispenser. Exterior surface 22*a* and interior space 22*b* are shown. Similar structures shown in other Figures, which have already been discussed herein, may not be repeated for clarity.

Figure 3:
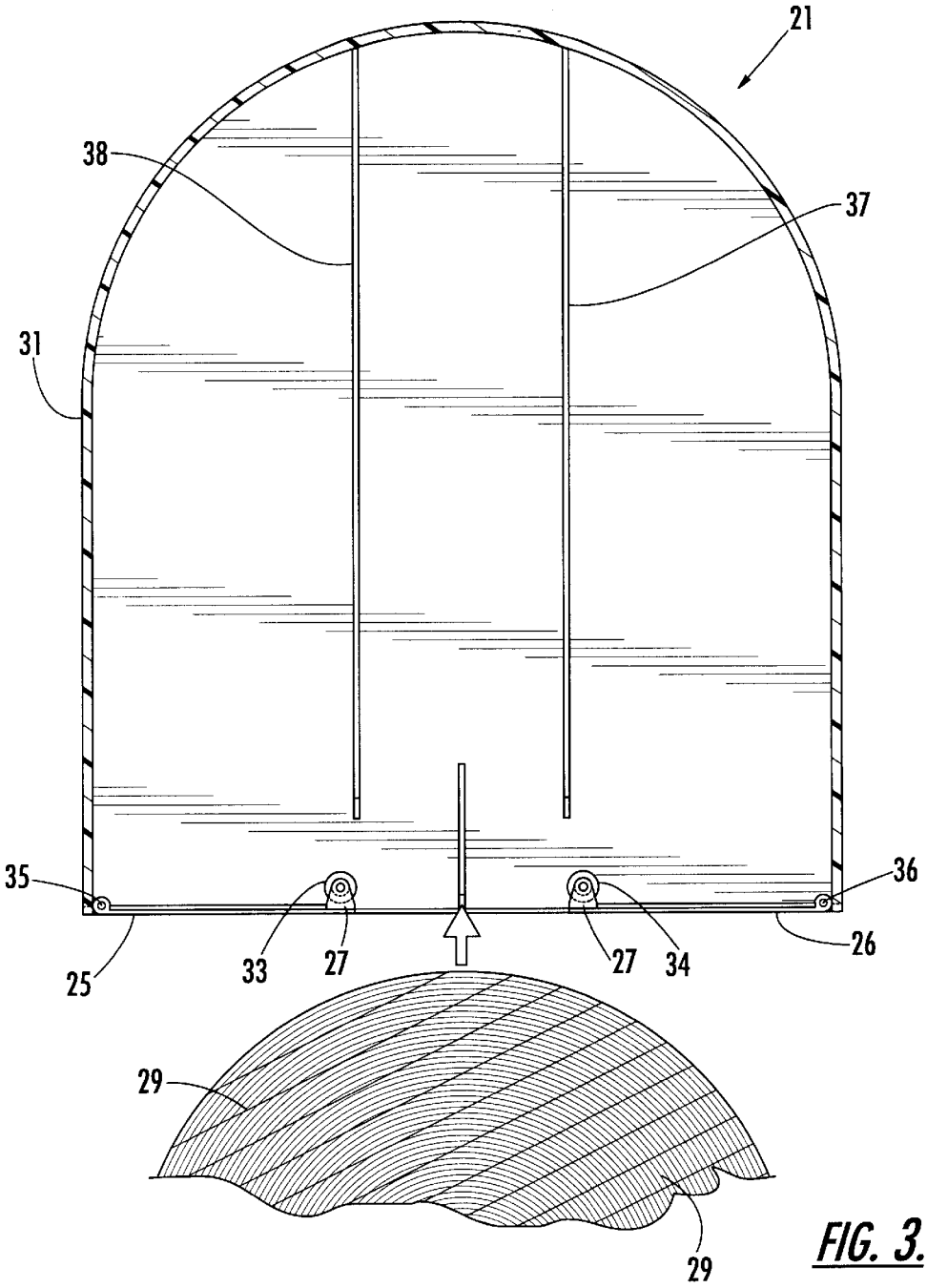
FIG. 3 depicts the first step in loading the dispenser of FIGS. 1 and 2.
Figure 4:
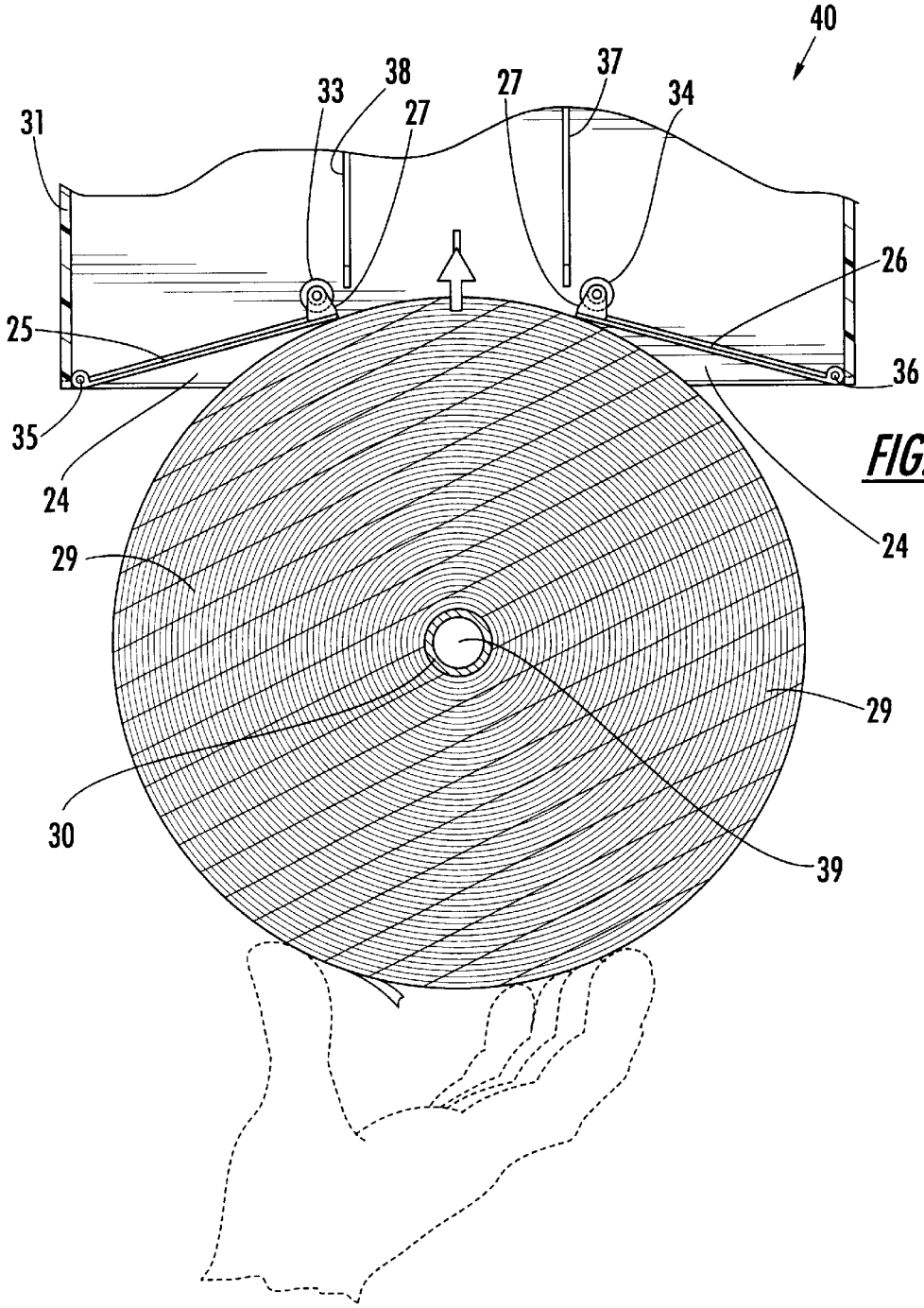
FIG. 4 shows the loading of a roll through the doorway in which doors hingedly open to facilitate insertion of a roll.

FIG. 3 shows the first step in loading a paper roll into the dispenser in which the roll is inserted from below. The doors 25 and 26 articulate upward to allow the roll to pass through the doorway and into the interior portion of the dispenser. In FIG. 4, a roll is shown which is about one-half of the way inserted into the dispenser, in which the roll surface itself supplies the force needed to move the doors to the side, thus allowing the roll to pass. Lower housing 40 is shown.

The paper roll 29 shown in that Figure is cored, comprising core 30 and center space 39. However, one significant advantage of this invention is that it can accept rolls which are cored, coreless, or even damaged on their center margin. This dispenser is universal in that no particular center axis structure is necessary to dispense paper successfully, and commercially available rolls having a core work as well as rolls which are coreless. This provides additional flexibility to restroom maintenance personnel, because the dispenser can accept either roll. Further, even coreless rolls that have been damaged or bent on their center point, and otherwise cannot be dispensed in existing dispensers, can be successfully used in the dispenser of this invention. This advantage reduces the waste of slightly damaged paper rolls. Furthermore, rolls may be of various sizes, and it is not required that the core be of any particular size. Thus, many different manufacturer's rolls may be used, and variances in core diameter are not a problem in the use of this invention.

Figure 5:
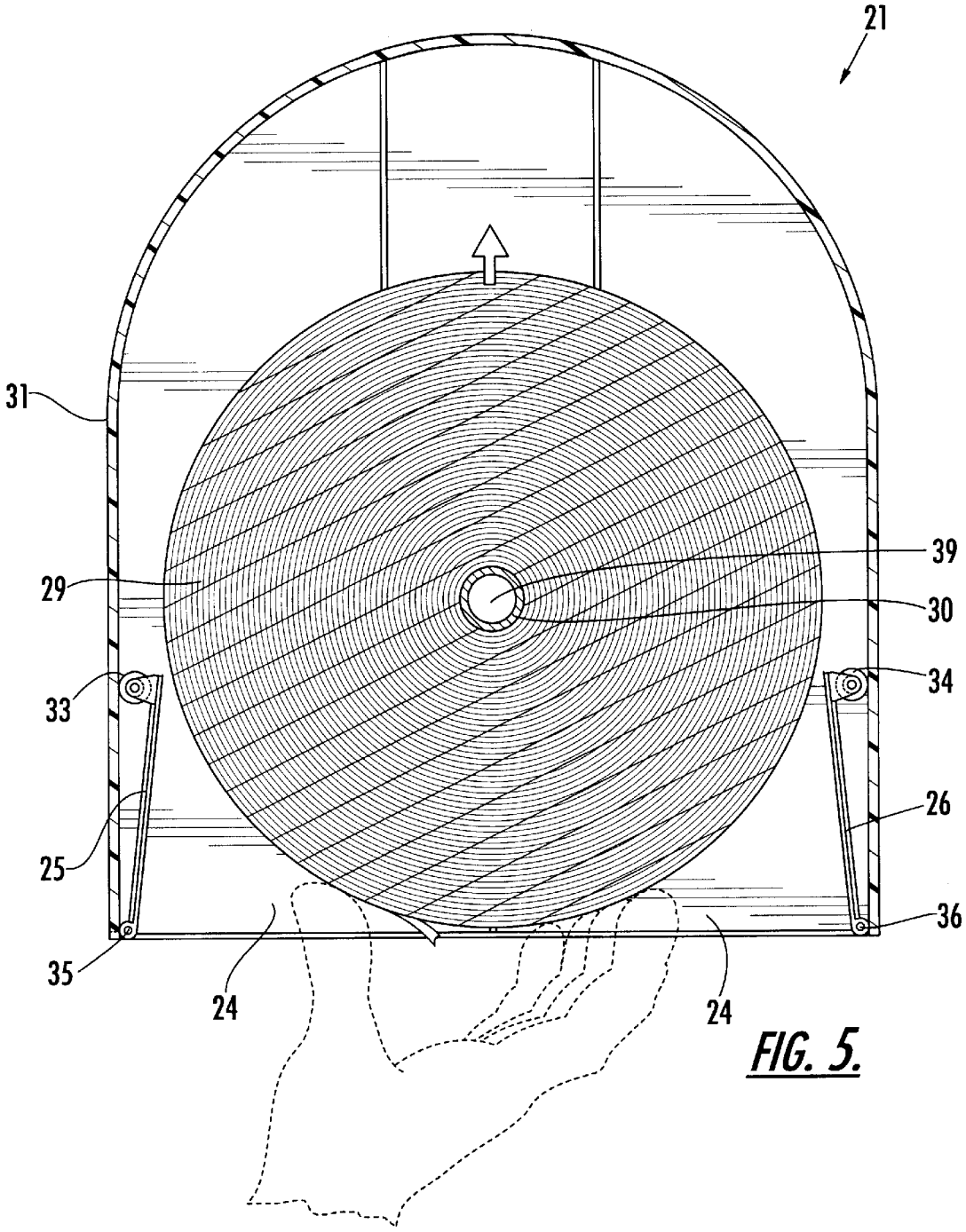
FIG. 5 is an illustration of a roll being further inserted into the interior of the housing of the dispenser.
Figure 6:
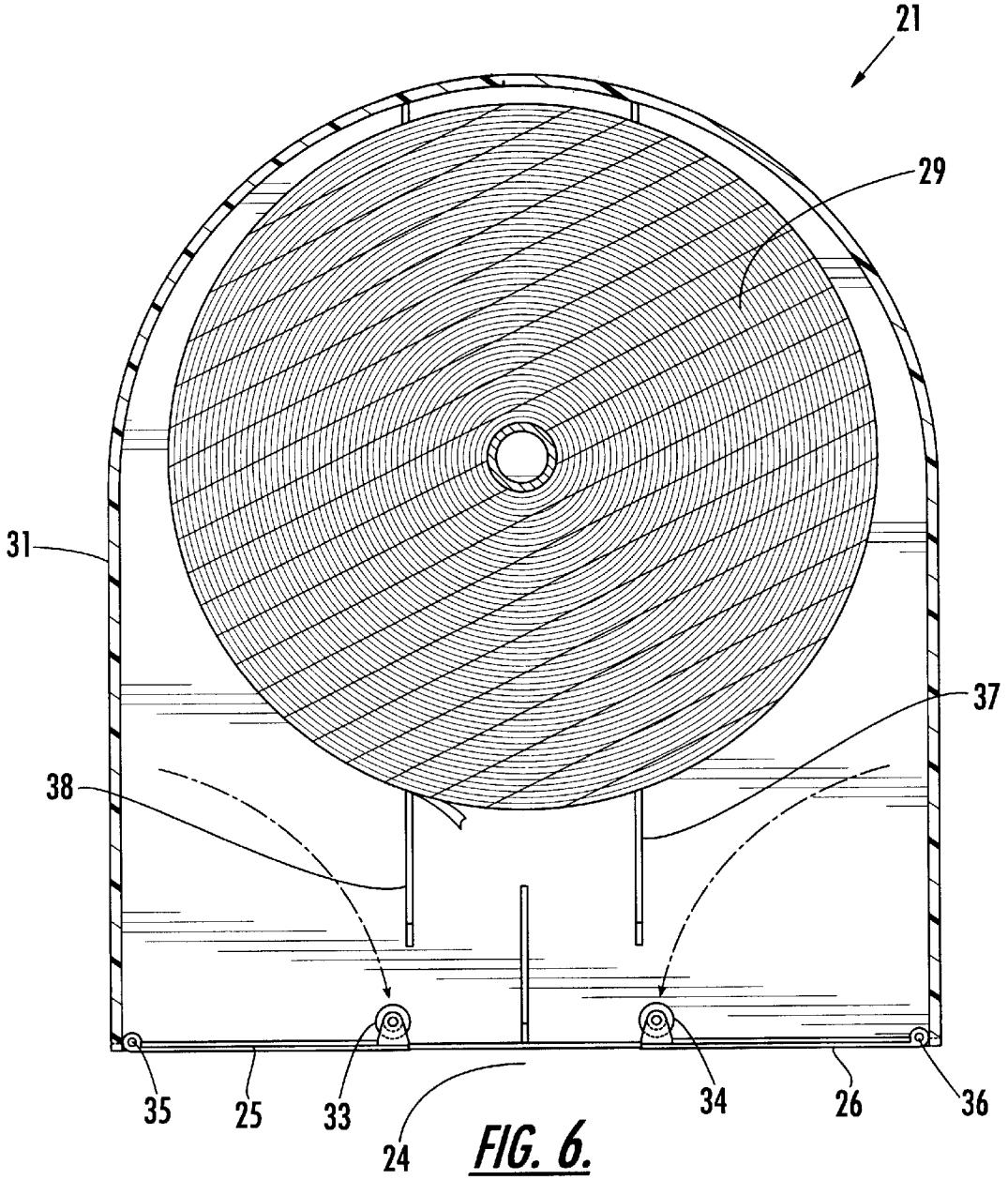
FIG. 6 shows a roll fully inserted into the dispenser, whereby the hinged doors are dropped back into place to form a support platform upon which the roll will rest.

FIG. 5 shows a roll partially inserted into the dispenser. The doors 25 and 26 have been pushed upward. FIG. 6 shows the roll at its peak, and the paper roll is pushed far enough into the dispenser to facilitate the lowering of the doors back into position for supporting the roll on its underside. Thus, the doorway is again partially blocked once the doors return to their horizontal position.

Figure 7:
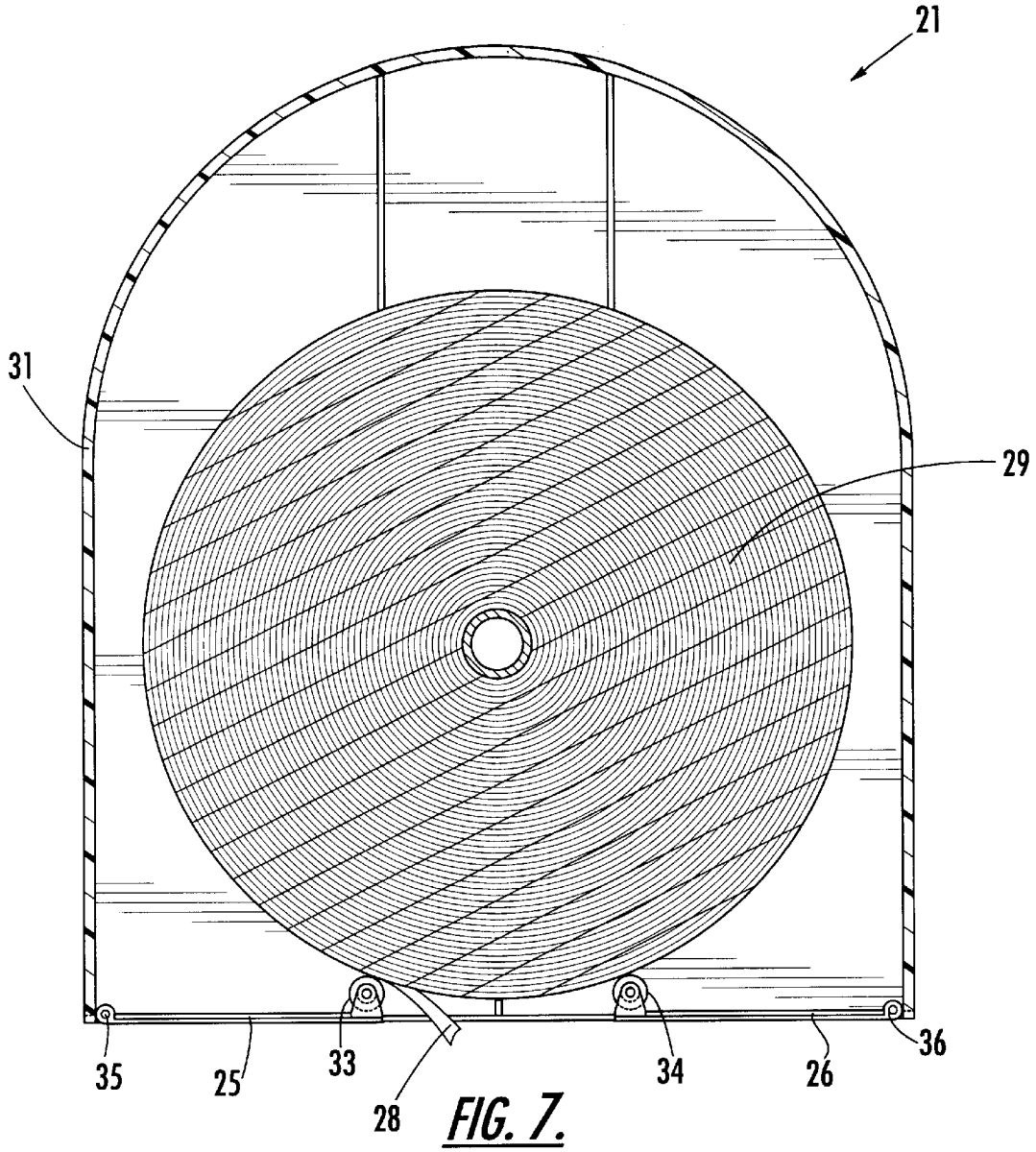
FIG. 7 is a side view showing the roll resting upon the support frame.
Figure 8:
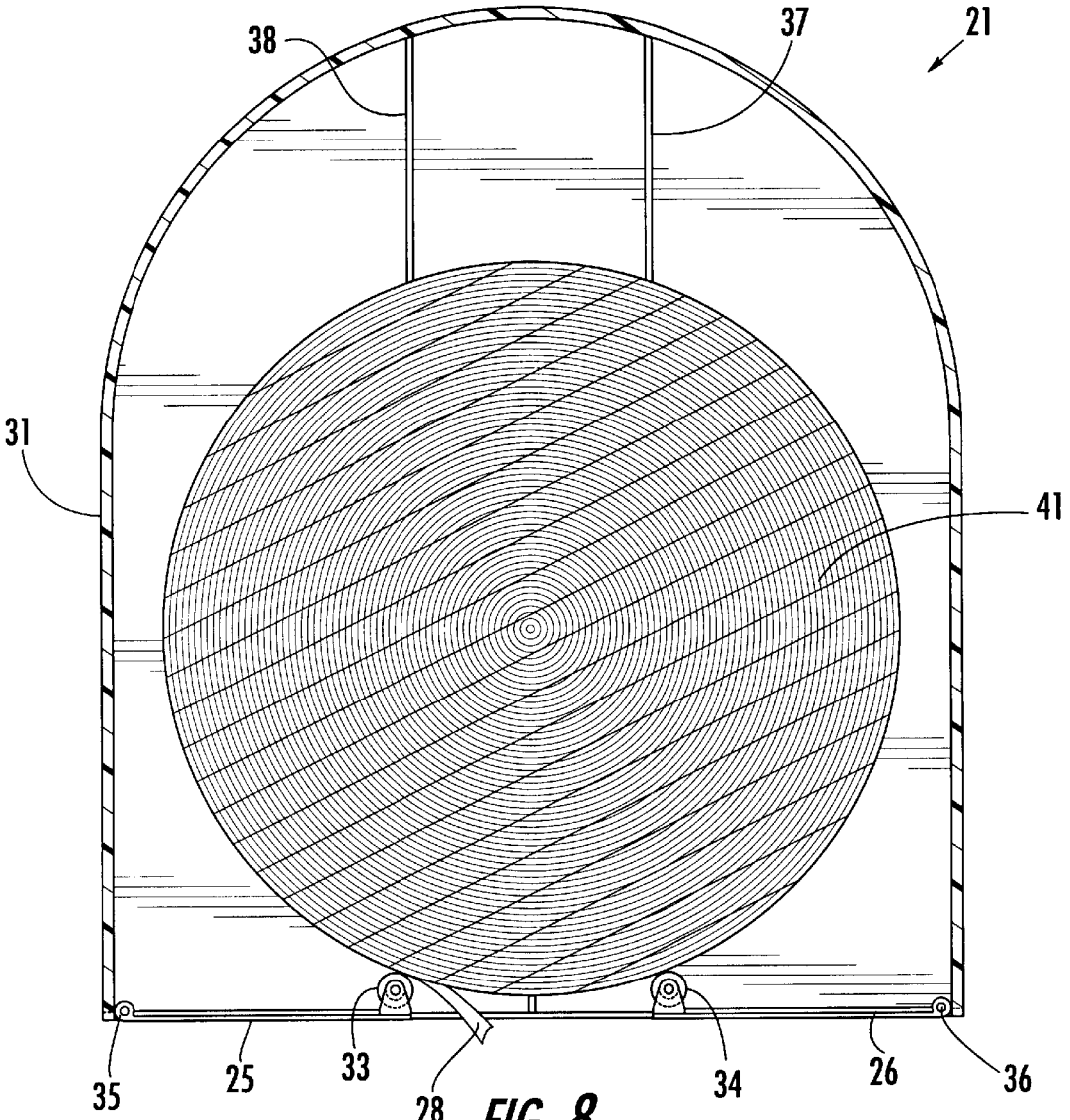
FIG. 8 shows a paper roll (coreless) in the dispensing position.
Figure 9:
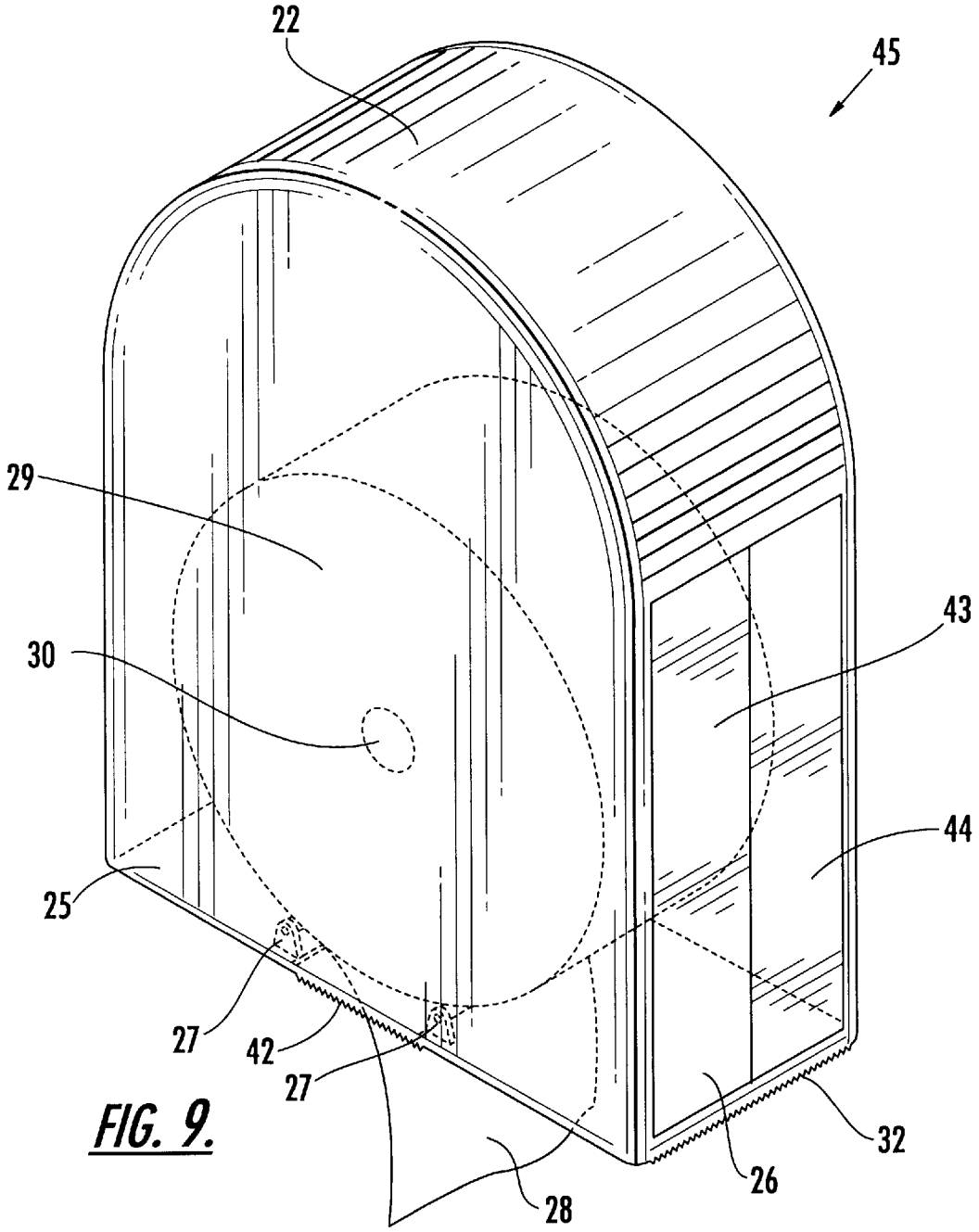
FIG. 9 is an illustration of an alternate embodiment of the invention in which the support frame is fixed in place within the housing, but the side doors hingedly articulate to facilitate the insertion of a roll into the housing.

FIG. 7 shows the roll in a next step, resting on the support frame comprised of roller guide 33 and roller guide 34. A coreless roll is featured in FIG. 8, as an alternative embodiment. FIG. 9 shows an alternate embodiment of the invention in which the support frame is stationary, and does not move upwards. Side loading dispenser 45 is shown. Instead of providing hinged doors below the dispenser, this alternate embodiment comprises first side door 43 and second side door 44, provided on the side of the dispenser, and paper rolls are loaded into the side, rather than loaded upwards from the bottom. This particular embodiment is useful for installations in which the mounted dispenser is supported on a wall just above a support rail, as for example in restroom stalls for handicapped or elderly persons. Many of such stalls have mounted on their walls rails used by such persons for stability and support. This alternative embodiment facilitates easy loading in such stalls, where loading from the bottom of the dispenser would not be practical or convenient.

Figure 10:
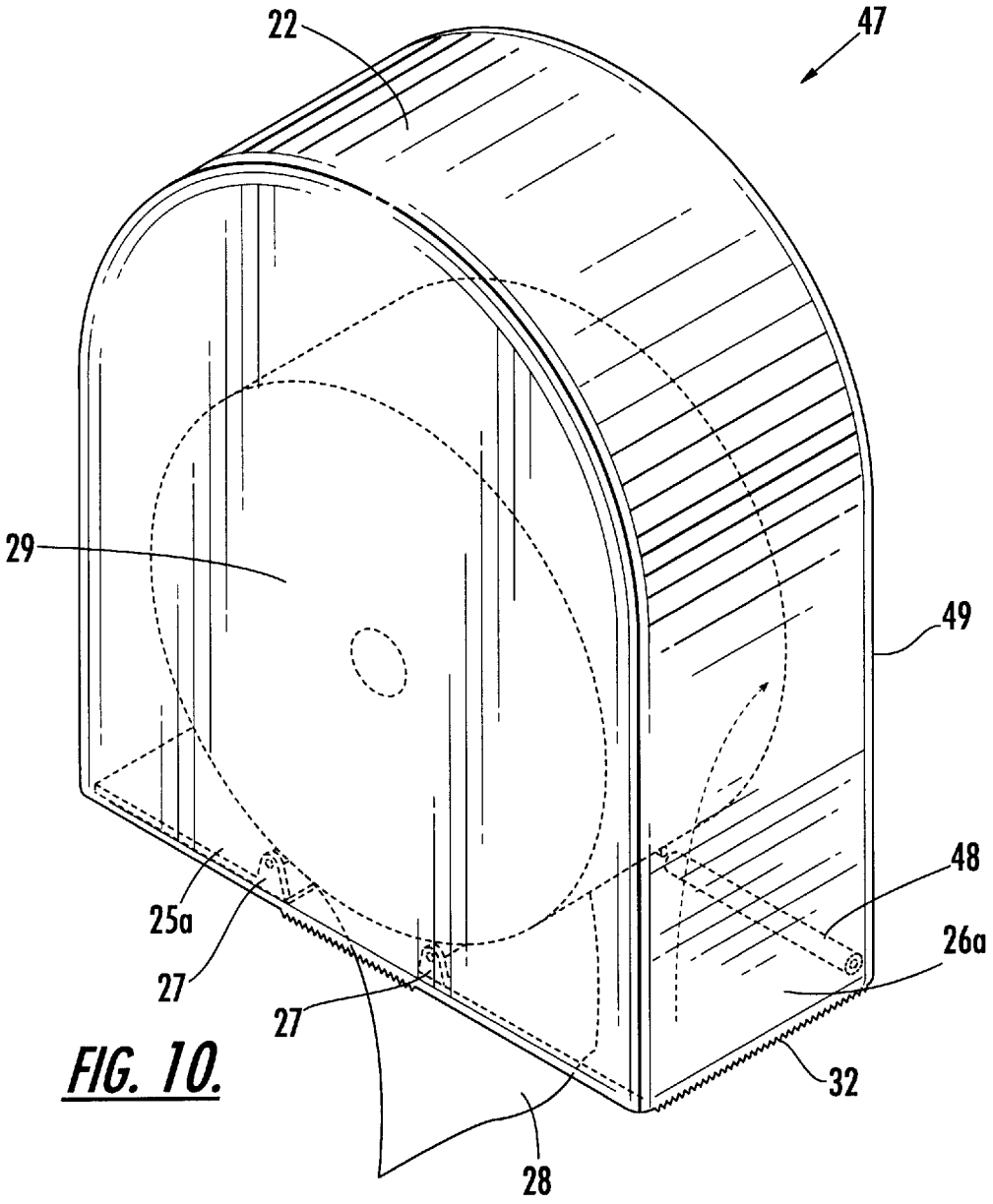
FIG. 10 shows an alternate embodiment of the invention in which a paper roll rests upon a support structure, wherein the doors of the support structure hingedly connect on the back side of the dispenser.

FIG. 10 shows an alternative embodiment, side hinge dispenser 47, which provides doors to hingedly articulate on the bottom of the dispenser housing. Side hinge doors 25*a* and 25*b* are shown. Hinge 48 is seen on the back side of the dispsenser. However, in this alternate embodiment, the doors hinge on the back wall 49 of the dispenser and lay flat against the back wall when they are pushed upwards by the paper roll during insertion. This configuration may provide certain advantages which are not realized with other configurations having hinges on the narrow side of the dispenser. For example, having both door hinges along the same line may reduce manufacturing costs, or increase the overall stability and strength of the dispenser unit.

It is understood by one of ordinary skill in the art that the present discussion is a description of exemplary embodiments only, and is not intended as limiting the broader aspects of the present invention, which broader aspects are embodied in the exemplary constructions. The invention is shown by example in the appended claims.

What is claimed is:

1. A dispenser adopted for releasing rolled paper, comprising:

(a) a substantially closed housing, the housing having an exterior surface on the outside of the housing and an interior space on the inside of the housing, the housing having a dispensing side from which rolled paper products may be dispensed, (b) a doorway having at least one door that divides the exterior surface of the housing from the inside of the housing the doorway providing an entry point capable of accommondating the insertion of a rolled paper product through the doorway from the outside of the housing to the housing to the interior of the housing, (c) a support frame connected to the housing and capable of supporting a rolled paper product in a position to dispense paper to the outside of the housing, and (d) a roller guide, the roller guide being mounted on the support frame, wherein the rolled paper contacts the roller guide, the roller guide providing a rotatable contact surface for dispensing rolled paper.

2. The device of claim 1 further comprising a second roller guide.

3. The device of claim 1 wherein the door is attached to the housing by a hinge.

4. The device of claim 1 wherein the door operates as a support frame on the dispensing side of the dispenser.

5. The device of claim 1 wherein the doorway is bounded by more than one door.

6. The device of claim 1 further including a second roller guide.

7. An apparatus for dispensing rolled paper, comprising:

(a) a housing, the housing having an exterior surface on the outside, and an interior space on the inside of the housing, the housing having a dispensing side from which rolled paper products may be dispensed, (b) a doorway, the doorway providing an entry point capable of accommodating the insertion of a rolled paper product through the doorway from the outside of the housing to the interior of the housing, wherein the doorway is located on the dispensing side of the apparatus, (c) a plurality of doors located in the doorway, the doors being connected to the housing and capable of articulation between at least two positions comprising:

(i) a first position supporting a rolled paper product for dispensing paper to the outside of the housing, and (ii) a second position enabling the insertion of a roll of paper through the doorway, from the exterior of the housing to the interior space of the housing, and (d) a roller guide, the roller guide being mounted on a door, wherein the roll ed paper contacts the roller guide, wherein the roller guide provides a rotatable contact surface bearing against the rolled paper for dispensing paper to the out side of the housing.

8. The apparatus of claim 7 additionally comprising a second roller guide.

9. The apparatus of claim 7 in which the doorway facilitates the loading of a new roll of paper with only one hand.

10. The apparatus of claim 7 in which the paper may be dispensed in either a clockwise or counterclockwise rotation.

11. The apparatus of claim 7 in which the doorway is comprised of at least two doors, wherein the first door contains a roller guide and the second door contains a roller guide.

12. The apparatus of claim 7 in which the doors, while in the first position, do not completely block the doorway.

13. The apparatus of claim 12 further wherein while the doors are in the first position, it is possible to touch the rolled paper from an extended hand through the doorway.

14. The apparatus of claim 12 in which the doors are hinged.

15. The apparatus of claim 12 in which the outer circumferential surface of the rolled paper is biased against at least two guide rollers while dispensing paper to the outside of the housing.

16. The apparatus of claim 12 further wherein centering ribs are located on the inside surface of the housing.

17. An dispenser for dispensing coreless or cored rolled paper, comprising:

(a) a housing, the housing having an exterior surface on the outside, and an interior space on the inside of the housing, the housing having a dispensing side on its lower exterior surface from which rolled paper products may be dispensed, (b) a doorway on the dispensing side of the housing, the doorway providing an entry point capable of accommodating the insertion of a rolled paper product through the doorway from the outside of the housing to the interior of the housing, wherein the doorway is located on the lower exterior surface of the dispenser, (c) at least two doors located in the doorway, the doors being hingedly connected to the housing and capable of articulation between at least two hinged positions comprising:

(i) a first position supporting a rolled paper product for dispensing paper to the outside of the housing, and (ii) a second position enabling the insertion of a roll of paper through the doorway from the exterior of the housing to the interior space of the housing, and (d) at least two roller guides, the roller guides being mounted on doors, wherein the rolled paper rests upon the roller guides while in a dispensing position, further wherein the roller guides provide a rotatable contact surface bearing against the rolled paper for dispensing paper to the outside of the housing.

18. An dispenser, comprising:

(a) a housing, the housing having an exterior surface on the outside, and an interior space on the inside of the housing, the housing having a dispensing side on its lower exterior surface from which rolled paper products may be dispensed, (b) a doorway on the dispensing side of the housing, the doorway providing an entry point capable of accommodating the insertion of a rolled paper product through the doorway from the outside of the housing to the interior of the housing, wherein the doorway is located on the lower exterior surface of the dispenser, (c) at least two doors located in the doorway, the doors being hingedly connected to the housing and capable of articulation between at least two hinged positions comprising:

(i) a first position supporting a coreless rolled paper product for dispensing paper to the outside of the housing, and (ii) a second position enabling the insertion of a coreless roll of paper through the doorway from the exterior of the housing to the interior space of the housing, and (d) at least two roller guides, the roller guides being mounted on the doors, wherein the rolled paper rests upon the roller guides while in a dispensing position, further wherein the roller guides provide a rotatable contact surface bearing against the outer circumferential surface of the rolled paper for dispensing the coreless rolled paper to the outside of the housing.

19. A method of dispensing a paper roll from a dispenser with reduced friction, comprising:

(a) providing a substantially enclosed housing, the housing having an exterior surface on the outside and an interior space on the inside of the housing, (b) providing a doorway, wherein the doorway comprises at least on door that divides the exterior surface of the housing from the inside of the housing, provides:

i) the paper roll entry point for re-loading the dispenser with a paper roll, and ii) an exit point for paper dispensed from the dispenser, wherein the doorway is bounded by at least one door capable of opening to the outside of the dispenser, (c) opening the door, (d) inserting a paper roll through the doorway and into the dispenser, (e) resting the paper roll upon a pair of guide rollers, and (f) feeding paper through the doorway to the outside of the dispenser.

* * * * *